US010465680B1

(12) United States Patent
Guerra

(10) Patent No.: US 10,465,680 B1
(45) Date of Patent: Nov. 5, 2019

(54) DISCHARGE CAP AND BLOCK FOR A FLUID END ASSEMBLY

(71) Applicant: Jesse Guerra, Alice, TX (US)

(72) Inventor: Jesse Guerra, Alice, TX (US)

(73) Assignee: VP Sales and Company LP, Alice, TX (US)

( * ) Notice: Subject to any disclaimer, the term of this patent is extended or adjusted under 35 U.S.C. 154(b) by 0 days.

(21) Appl. No.: 15/978,745

(22) Filed: May 14, 2018

(51) Int. Cl.

| | |
|---|---|
| ***F04B 53/16*** | (2006.01) |
| ***F04B 19/22*** | (2006.01) |
| ***F04B 53/10*** | (2006.01) |
| ***F04B 1/04*** | (2006.01) |
| *F04B 53/14* | (2006.01) |

(52) U.S. Cl.
CPC ..... *F04B 53/16* (2013.01); *F04B 1/0421* (2013.01); *F04B 19/22* (2013.01); *F04B 53/10* (2013.01); *F04B 53/1087* (2013.01); *F04B 53/162* (2013.01); *F04B 53/14* (2013.01)

(58) Field of Classification Search
CPC .... F04B 53/007; F04B 53/16; F04B 53/1022; F04B 53/1087; F04B 53/162; F04B 53/22
See application file for complete search history.

(56) References Cited

U.S. PATENT DOCUMENTS

| | | | | |
|---|---|---|---|---|
| 4,771,801 | A * | 9/1988 | Crump | F04B 49/121 137/68.26 |
| 5,073,096 | A | 12/1991 | King | |
| 7,186,097 | B1 | 3/2007 | Blume | |
| 7,513,759 | B1 | 4/2009 | Blume | |
| 8,784,081 | B1 | 7/2014 | Blume | |
| 8,915,722 | B1 * | 12/2014 | Blume | F04B 53/007 137/543.23 |
| 2013/0319220 | A1 * | 12/2013 | Luharuka | F04B 53/164 92/165 R |
| 2015/0361745 | A1 * | 12/2015 | Guerra | F04B 1/0421 417/437 |
| 2016/0245280 | A1 * | 8/2016 | Todorov | F04B 53/007 |
| 2017/0082103 | A1 * | 3/2017 | Morreale | F04B 39/10 |

* cited by examiner

*Primary Examiner* — Dominick L Plakkoottam
(74) *Attorney, Agent, or Firm* — M. Susan Spiering; Ferrell's PLLC

(57) ABSTRACT

Disclosed herein is an improved fluid end discharge cap and bore to minimize or avoid cavitation during use of a reciprocating fluid end pump and hence prolong the use and life of the fluid end assembly. The improved design included modifying the current cylindrical discharge cover or cap to a tapered, conical or convex design, enlarging the discharge bore, and recessing seat decks into the suction and discharge bores, to avoid fluid flow obstructions and increase volume flow. The pump outlet bore was enlarged and the bore height and diameter were increased to further increase flow. The conventional design has edges and ninety-degree angles which tended to allow for fluid media to remain in the bore and trigger pump cavitation. The current inventive design has eliminated restrictions, in particular 90° angles, to allow uninterrupted fluid flow therein.

10 Claims, 8 Drawing Sheets

DISCHARGE CAP AND BLOCK FOR A FLUID END ASSEMBLY

FIELD OF THE INVENTION

The present invention relates to a reciprocating pump. More particularly, the present invention relates to an improved block and discharge cap for a fluid end assembly of a reciprocating pump.

DESCRIPTION OF THE RELATED ART

The present application is filed under request for prioritized examination track one (1) under 37 CFR 1.102(e).

A reciprocating pump is a positive-displacement pump that typically utilizes a crankshaft mechanism for pumping fluid at high pressures. Examples of the reciprocating pump include piston pumps, plunger pumps, and diaphragm pumps. The reciprocating pump is used to pump fluid into a storage container for storing the fluid. A plunger pump includes a plunger that reciprocates in a chamber and creates volume changes that result in flow of fluid in to and out of the chamber. When the plunger retracts, the fluid flows into the chamber. When the plunger extends, the fluid is forced out of the chamber. The reciprocating pump usually includes a fluid end that receives the fluid through an inlet bore, and ejects the fluid from an outlet bore. The fluid end includes multiple threaded bores for facilitating the reciprocating motion of a plurality of plungers. The plungers perform a reciprocating motion through multiple threaded bores for facilitating the motion of high pressure fluid through the fluid end.

FIGS. 1-3 broadly illustrate the prior art (or conventional) design and are used herein for illustrative purposes. FIG. 1 shows a perspective view of a conventional fluid end 100 for a reciprocating pump (complete pump not shown). The fluid end block (herein referred to as "fluid end" or "block") 100 includes first through fifth horizontal bores 102*a*-102*e* (individually referred to as "a horizontal bore 102" and collectively as "horizontal bores 102"). The fluid end 100 further includes first through fifth discharge bores 104*a*-104*e* (individually referred to as "a discharge bore 104" and collectively as "discharge bores 104") and a pump outlet 106 that runs parallel to a length of the fluid end 100.

FIG. 2 shows a sectional side view of the interior of the conventional fluid end 100 of FIG. 1. The fluid end 100 further includes a plunger bore 108 and a suction bore 110. The horizontal bore 102, the plunger bore 108, and the discharge bore 104 are threaded with buttress, ACME, fine, or unified threads near their end portions. The horizontal bore 102, the discharge bore 104, the plunger bore 108, and the suction bore 110 intersect to create a cavity 112 in the fluid end 100. The fluid end 100 further includes a valve seat 114 that is placed in the discharge bore 104, and further protrudes out of the discharge bore 104 and into the pump outlet 106.

FIGS. 3A and 3B collectively illustrate side and sectional side views of a conventional fluid end assembly 200 which includes the fluid end 100 of FIGS. 1 and 2. The fluid end assembly 200 includes a first spring actuated valve 202 received by the suction bore 110. The fluid end assembly 200 further includes a second spring actuated valve 204 that is received by the discharge bore 104. The second spring actuated valve 204 is further held in place by way of the valve seat 114. The discharge bore 104 further receives a discharge cover 206 above the second spring actuated valve 204. The discharge cover 206 has top and bottom sections 206*a* and 206*b*. The bottom section 206*b* is in contact with the second spring actuated valve 204. The horizontal bore 102 receives a plug 208. The plunger bore 108 receives a plunger 210 extending up to the cavity 112.

FIG. 3C shows a side view of the bottom section 206*b* of a conventional discharge cover 206. The bottom section 206*b* of this prior art cover is generally cylindrical in shape, and further protrudes into the pump outlet 106.

High pressure flow of fluid in the fluid end 100 of conventional blocks often leads to cavitation therein and lessens the life and performance of the fluid end 100. The fluid end 100 is highly susceptible to cavitation and damage due to the continuous reciprocating movement of the plunger 210 through the plunger bore 108. Flow of high pressure fluid in the fluid end 100 may also lead to widening of cracks and crevices formed therein, and may further lead to fracturing of the fluid end 100. If the pressure inside the fluid end 100 is very high, the fluid may be spewed out at a high velocity causing damage to the reciprocating pump and may further hamper the safety of the pump operators. Further, cavitation in the fluid end 100 also decreases the life thereof, increasing the costs for operating the reciprocating pump. Since the valve seat 114 and the bottom portion 206*b* of the discharge cover 206 protrude into the pump outlet 106, the flow of the fluid is hampered, and further leads to increase in the pressure in the cavity 112. Further increase in the pressure of the cavity 112 may compound the cavitation in the fluid end 100, thereby reducing the life thereof.

The reciprocating pump is typically used in oil drilling mechanisms to pump the fluid into rock formations that contain oil. To meet the increasing demand of oil, the reciprocating pump needs to pump the high-pressure fluid at high volume rates. Conventional fluid ends such as the fluid end 100 may undergo cavitation, and may crack while pumping the fluid at high volume rates. Further, the conventional fluid ends may undergo corrosion, and need regular replacement.

U.S. Pat. No. 7,186,097 discloses a plunger pump housing. The plunger pump housing includes a discharge bore, a plunger bore, an access bore, and a suction bore. The plunger pump housing further includes a discharge cover that rests above a discharge valve in the discharge bore. The discharge cover is cylindrical in shape.

U.S. Pat. No. 7,513,759 discloses a valve guide and spring retainer assembly.

U.S. Pat. No. 5,073,096 discloses a front discharge fluid end for a reciprocating pump. The front discharge fluid end comprises a housing means that includes a cylinder therein. The front discharge fluid end further comprises a plunger bore. A plug assembly is inserted in the cylinder to facilitate discharge of the fluid from an end of the plunger bore. The shape of the plug assembly shown is cylindrical. Cavitation is known to occur in the fluid end shown in US'096.

U.S. Pat. No. 8,915,722 to Blume discloses an integrated fluid end having tapered valve guide and spring retainer assemblies. This design describes seats which are entirely tapered or conical on the outside, while standard seat designs have cylindrical and conical section with a shoulder.

U.S. Pat. No. 8,784,081 to Blume discloses fatigue failure in plunger pump fluid end assemblies.

In light of the foregoing, there exists a need for a fluid end assembly that enhances flow volume through the reciprocating pump, prevents corrosion, and has a longer operating life.

SUMMARY

Disclosed herein is an improved fluid end discharge cap and bore to minimize or avoid cavitation during use of a reciprocating fluid end pump and hence prolong the use and life of the fluid end assembly. The discharge cap and bore were improved to reduce pressure head losses, excess velocity, and fluid starvation which tend to cause cavitation in the pump. In general, the standard commercially available pumps operated for about 400 hours with cavitation, while the improved pump disclosed herein operated for at least 20% more hours before any pump failure occurred. It is suggested to employ stainless steel to minimize corrosion occurring with the abrasive fluids which flow through the assembly during use. The improved design includes modifying the current cylindrical discharge cover or cap to a tapered, conical design, enlarging the discharge bore, and recessing seat decks to avoid obstructions and increase the volume flow. The pump outlet bore was modified from 3.25 inches found in conventional assembly bores, to 3.50 inches. The bore height and diameter were increased to increase the flow. The conventional design has edges and ninety-degree angles which tended to allow for fluid media, such as sand, to remain in those spaces and exacerbate pump cavitation. The current inventive design has eliminated restrictions to fluid flow, thus extending the life of the pump assembly.

In one embodiment of the present invention, a fluid end for a reciprocating pump is provided. The fluid end comprises a body, a plunger bore, a suction bore, a discharge bore, a horizontal bore, a reciprocating plunger, an inlet valve, a first valve seat deck, a pressure relief valve, a discharge cover, a second valve seat deck, and an outlet pocket. The plunger bore is formed in the body along a first axis. The suction bore is formed in the body along a second axis. The suction bore receives fluid from a conduit. The discharge bore is formed in the body, and is aligned to the suction bore. The horizontal bore is formed in the body and is aligned with the plunger bore. The plunger bore, the suction bore, the discharge bore, and the horizontal bore intersect to form a cavity. The reciprocating plunger reciprocates in the plunger bore. The inlet valve is received by the suction bore for facilitating flow of the fluid from the conduit into the cavity by way of the suction bore. The first valve seat is at an end portion of the suction bore and is in contact with the inlet valve. The pressure relief valve is received by the discharge bore for facilitating flow of the fluid from the cavity into the discharge bore. The discharge cover is received by the discharge bore and is in contact with the pressure relief valve. The discharge cover is tapered at a first end thereof. The discharge cover is confined within the discharge bore. The second valve seat is at an end portion of the discharge bore and is in contact with the pressure relief valve. The outlet pocket is defined at an inner surface of the discharge bore and provides a passage for flow of the fluid from the discharge bore to the pump outlet. The pump outlet is cylindrical and is aligned along a third axis. The inlet valve allows the fluid to flow into the cavity based on a reciprocating motion of the reciprocating plunger by way of the suction bore. The pressure relief valve allows the fluid to flow from the cavity to the discharge bore based on the reciprocating motion of the reciprocating plunger.

The inventive discharge cover is tapered, leading to elimination of sharp edges in the fluid end. Further, the first and second recessed valve seat decks provide stability to the reciprocating pump, and eliminate turbulence during the functioning of the pump.

BRIEF DESCRIPTION OF THE DRAWINGS

The accompanying drawings illustrate the various embodiments of systems, methods, and other aspects of the invention. It will be apparent to a person skilled in the art that the illustrated element boundaries in the figures represent one example of the boundaries. In some examples, one element may be designed as multiple elements, or multiple elements may be designed as one element. In some examples, an element shown as an internal component of one element may be implemented as an external component in another, and vice versa.

The features of the present invention, which are believed to be novel, are set forth with particularity in the appended claims. Embodiments of the present invention will hereinafter be described in conjunction with the appended drawings provided to illustrate and not to limit the scope of the claims, wherein like designations denote like elements, and in which:

FIG. 9B illustrates a detail view of the discharge bore of FIG. 9A, and FIGS. 9C and 9D correspond to the sectional side view of FIG. 4, with FIG. 9D illustrates a detail view of the discharge bore of FIG. 9C.

Further areas of applicability of the present invention will become apparent from the detailed description provided hereinafter. It should be understood that the detailed description of exemplary embodiments is intended for illustration purposes only and is, therefore, not intended to necessarily limit the scope of the present invention.

DETAILED DESCRIPTION OF EMBODIMENTS

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention.

There may be additional components described in the foregoing application that are not depicted on one of the described drawings. In the event, such a component is described, but not depicted in a drawing, the absence of such a drawing should not be considered as an omission of such design from the specification.

Before describing the present invention in detail, it should be observed that the present invention utilizes a combination of system components which constitutes a pump fluid end. Accordingly, the components and the method steps have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The present invention provides an improved fluid end assembly for a reciprocating pump that enhances the life of the reciprocating pump.

Figure 4:
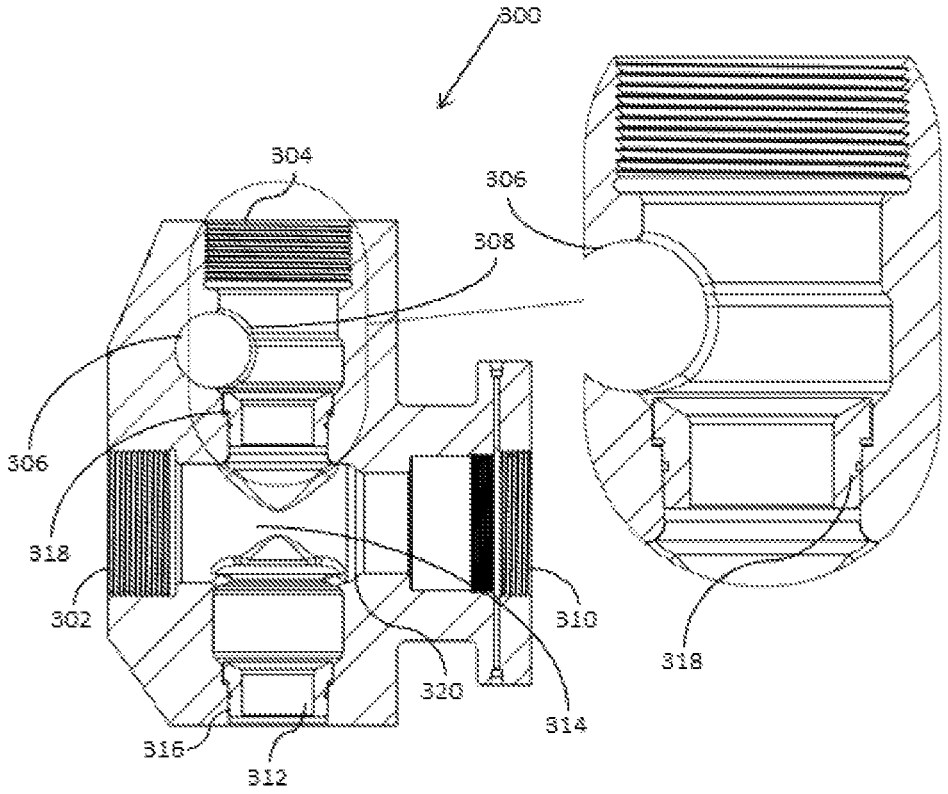
FIG. 4 shows sectional side view of a fluid end of a fluid end assembly, in accordance with an embodiment of the present invention.

FIG. 4 shows a sectional side view of a fluid end 300, in accordance with an embodiment of the present invention. The fluid end 300 includes first through fifth horizontal bores out of which the first horizontal bore 302 (hereinafter referred to as "a horizontal bore 302" and collectively as "horizontal bores 302") is shown. The horizontal bore 302 is formed in the fluid end 300 along a horizontal axis. The fluid end 300 further includes first through fifth discharge bores out of which the first discharge bore 304 (hereinafter referred to as "a discharge bore 304" and collectively as "discharge bores 304") is shown. The discharge bore 304 is formed in the fluid end 300 along a vertical axis.

The fluid end 300 further includes a pump outlet 306. The pump outlet 306 is cylindrical in shape and is formed along an axis that is perpendicular to the plane defined by the horizontal and vertical axes. The pump outlet 306 is enlarged as compared to conventional fluid ends, and has a diameter of 3.5 inches. However, it should be understood by a person skilled in the art that the diameter of the pump outlet 306 can be different from 3.5 inches, and typically lies in the range of 1 inch to 4 inches. The pump outlet 306 intersects the discharge bore 304 for forming an outlet pocket 308 in the fluid end 300. The discharge bore 304 is machined to eliminate sharp corners and edges therein. The fluid end 300 further includes first through fifth plunger bores out of which the first plunger bore 310 (hereinafter referred to as "a plunger bore 310" and collectively as "plunger bores 310") is shown. The fluid end 300 further includes first through fifth suction bores out of which the first suction bore 312 (hereinafter referred to as "a suction bore 312" and collectively as "suction bores 312") is shown. The plunger bore 310 is aligned to the horizontal bore 302 along the horizontal axis. The suction bore 312 is aligned to the discharge bore 304 along the vertical axis. The horizontal bore 302, the discharge bore 304, and the plunger bore 310 are threaded.

The horizontal bore 302, the discharge bore 304, the plunger bore 310, and the suction bore 312 intersect to form a cavity 314 in the fluid end 300. A first valve seat 316 is fit around and recessed into the suction bore 312. A second valve seat 318 is fit around and recessed into the discharge bore 304. The first and second valve seats 316 and 318 seal the suction and discharge bores. A vertical bore formed by the discharge and suction bores 304 and 312 intersects with the plunger bore 310 at an intersection 320. The intersection 320 is enlarged over conventional bores by machining to relieve operating stress.

Figure 5A:
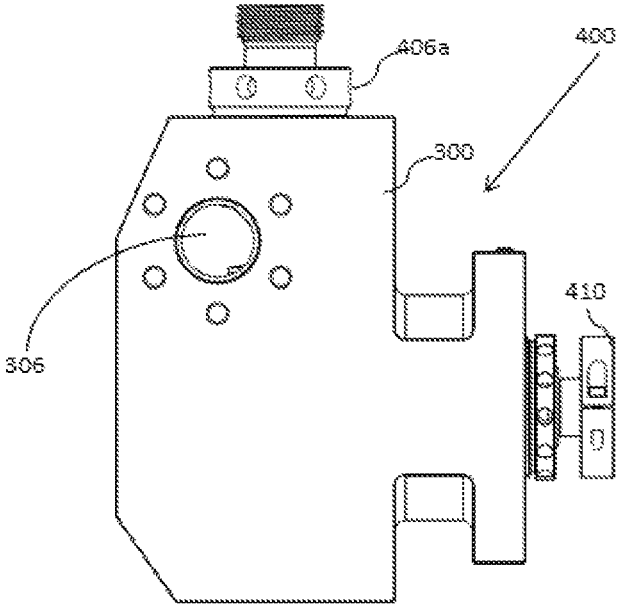
FIG. 5A shows a side view of the fluid end assembly, in accordance with an embodiment of the present invention.
Figure 5B:
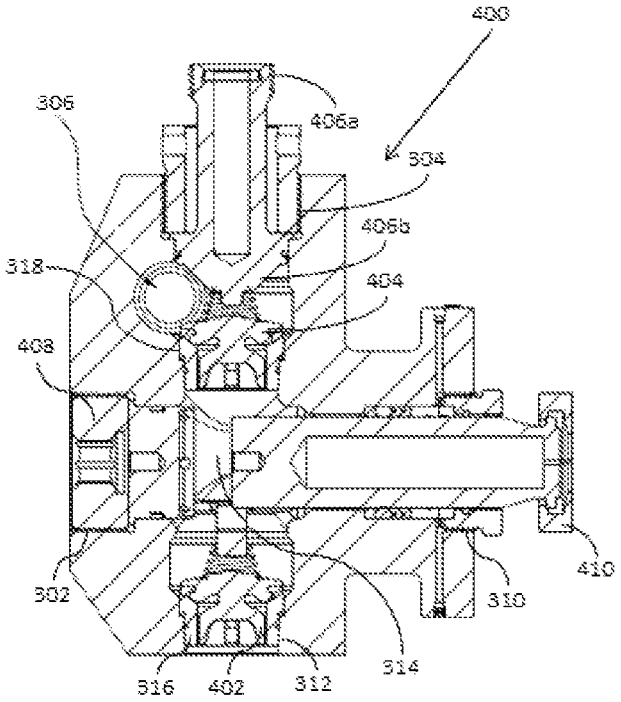
FIG. 5B shows sectional side view of the fluid end assembly, in accordance with an embodiment of the present invention.

Collectively referring to FIGS. 5A and 5B, side and sectional side views of a fluid end assembly 400, respectively, in accordance with an embodiment of the present invention are shown. The fluid end assembly 400 includes the fluid end 300. The fluid end assembly 400 further includes a first spring actuated valve 402 received by the suction bore 312. The first spring actuated valve 402 is an inlet valve. The first spring actuated valve 402 is held in place by way of the first valve seat 316 with valve seat. The seat is surrounded circumferentially by walls of the fluid end. The fluid end assembly 400 further includes a second spring actuated valve 404 that is received by the discharge bore 304. The second spring actuated valve 404 is a pressure relief valve. The second spring actuated valve 404 is held in place by way of the second valve seat 318 with valve seat. The discharge bore 304 further receives a discharge cover 406 (or "discharge cap 406") above the second spring actuated valve 404. The discharge cover 406 includes top and bottom sections 406*a* and 406*b*. The top section 406*a* is cylindrical in shape. The bottom section 406*b* is in contact with the second spring actuated valve 404.

Figure 1:
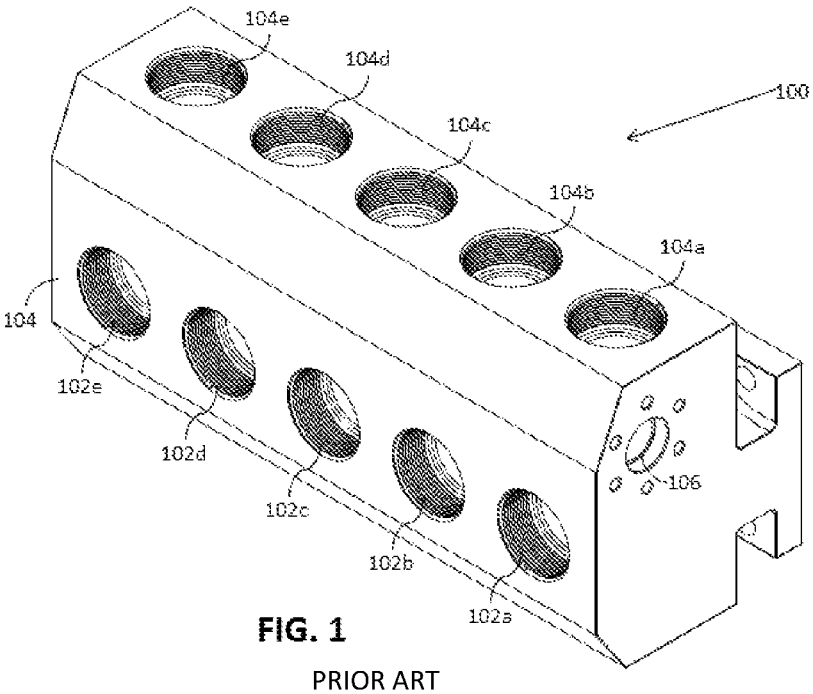
FIG. 1 PRIOR ART
FIG. 1 shows a perspective view of a fluid end of a conventional fluid end assembly.
Figure 2:
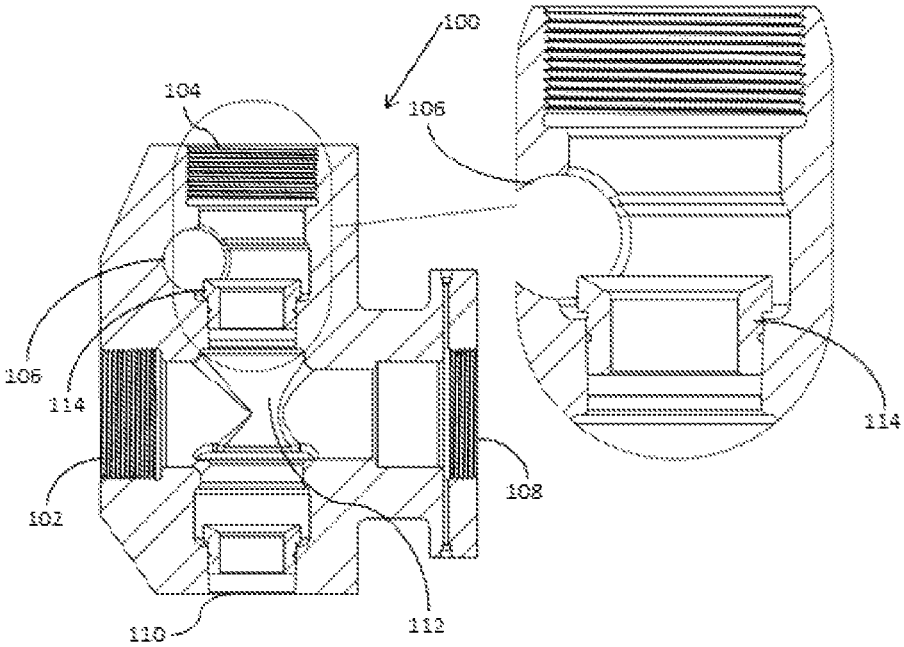
FIG. 2 PRIOR ART
FIG. 2 shows a sectional side view of the interior of the fluid end of the conventional fluid end assembly.
Figure 3A:
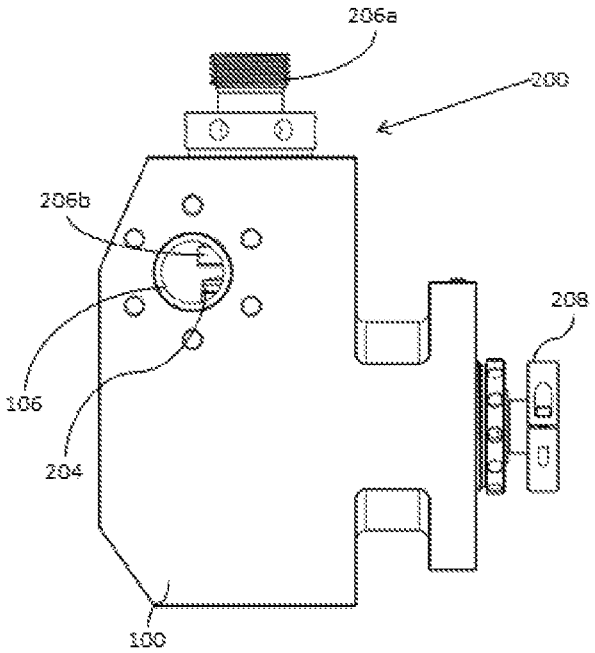
FIG. 3A PRIOR ART
FIG. 3A shows a side view of the conventional fluid end assembly.
Figure 3B:
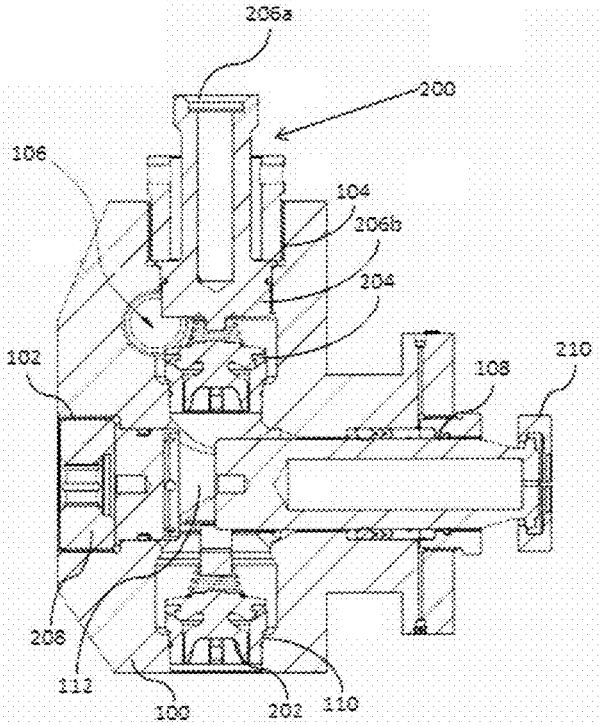
FIG. 3B PRIOR ART
FIG. 3B shows a sectional side view of the conventional fluid end assembly.
Figure 3C:
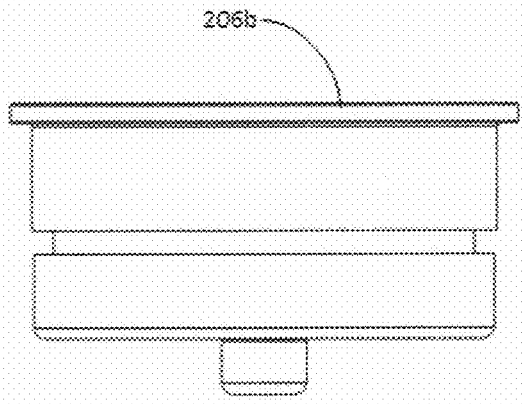
FIG. 3C PRIOR ART
FIG. 3C shows a side view of a bottom section of a discharge cover of the conventional fluid end assembly.

The horizontal bore 302 receives a plug 408 that is rotatably fixed into the horizontal bore 302 by way of the threaded end thereof. The plunger bore 310 receives a plunger 410 extending up to the cavity 314. The plunger 410 is connected to a crankshaft mechanism (not shown) by way of which the plunger 410 performs reciprocating motion in the plunger bore 310. The first and second spring actuated valves 402 and 404 are in contact with the first and second valve seats 316 and 318. The first and second valve seats 316 and 318 seal the suction and discharge bores 312 and 304, respectively, hence preventing leakage of fluid from the suction and discharge bores 312 and 304. Further, the second valve seat 318 is recessed lower into the discharge bore 304, as compared to valve seats in conventional fluid ends. This is more clearly seen when comparing FIG. 3A with FIG. 5A. FIG. 5A clearly has a greater area for fluid flow. Further, a clearance distance between the second valve seat 318 and an inner wall of the discharge bore lies between 0.01 inches to 0.03 inches. This greater area in the bore is due in part to the recessed seat deck. Heretofore, no one had determined a way to enlarge the horizontal bore while maintaining other key elements and features of the fluid end assembly intact.

Figure 6:
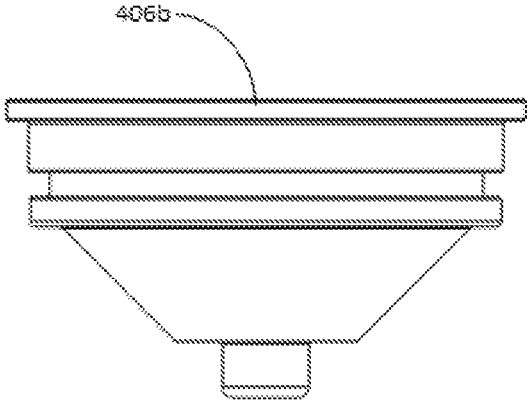
FIG. 6 shows a side conical view of a bottom section of a discharge bore of the fluid end assembly, in accordance with an embodiment of the present invention.
Figure 7:
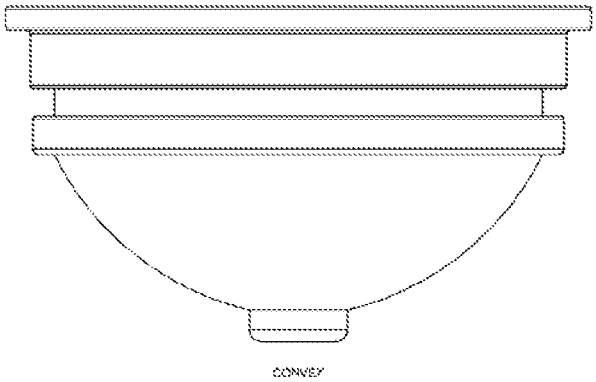
FIG. 7 shows a side convex view of a bottom section of a discharge bore of the fluid end assembly, in accordance with an embodiment of the present invention.
Figure 8:
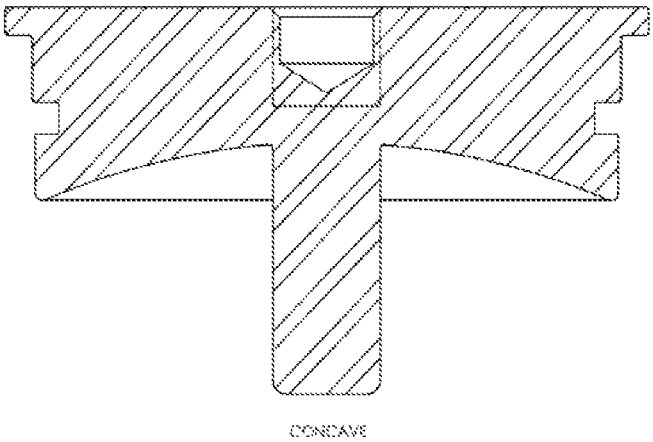
FIG. 8 shows a side concave view of a bottom section of a discharge bore of the fluid end assembly, in accordance with an embodiment of the present invention.

FIGS. 6, 7, and 8 illustrate respectively conical, convex, and concave side views of the bottom section 406*b* of the discharge cover 406, in accordance with an embodiment of the present invention. The angle from nipple upward is not significant provided the nipple of the discharge cover does not protrude into the bore. The modification of the shape to the bottom of the discharge cover (or cap) in combination with the recessed deck provides a feature of the uniqueness of the present invention. This combination had not been known to the industry prior to the present invention. The bottom section 406*b* is tapered to form a conical shape, and rests on a spring of the second spring actuated valve 404. In one embodiment, the bottom section 406*b* is concave in shape. In another embodiment, the bottom section 406*b* is convex in shape. Conventional fluid ends typically include discharge bores that are completely cylindrical in shape, and hence hamper the flow of the fluid through the pump outlet. The bottom section 406*b* is located in the discharge bore 304 such that the bottom section 406*b* extends into the outlet pocket 308. In an embodiment, the bottom section 406*b* has an angle of 45° with the discharge bore 304. Further, a cross section area of an intersection of the bottom section 406*b* and the outlet pocket 308 is less than 25%, preferably less than 20%, of a cross section area of the outlet pocket 308.

The bottom section 406*b* of the discharge cover 406 is conical, i.e., tapered as compared to a discharge cover of conventional fluid ends. Further, the second valve seat deck 318 does not protrude into the pump outlet 306. This causes higher volume of fluid to be pumped out from the fluid end assembly 400 without causing high pressure in the cavity 314. Lower pressure in the cavity 314 as compared to conventional fluid end assemblies prevents cavitation in the fluid end 300. Prevention of cavitation in the fluid end 300 delays the formation of cracks and crevices therein, hence prolonging the life of the fluid end assembly 400. Operating safety of the fluid end assembly 400 increases due to prevention of cavitation in the fluid end 300.

Further, operating cost of the fluid end assembly 400 is reduced due to the prolonged operating life thereof. The first and second valve seats 316 and 318 prevent leakage from the suction and the discharge bores 312 and 304, respectively, hence increasing the stability of the reciprocating pump and preventing a premature failure thereof. Further, since the clearance distance between the bottom section 406*b* and the discharge bore 304 is less as compared to conventional fluid end assemblies, the fluid being discharged through the outlet pocket 308 does not flow back into the discharge bore 304. This prevents formation of eddy currents in the cavity 314, thus facilitating a smooth flow of the fluid through the fluid end 300 and provides a better operability of the reciprocating pump. A large diameter of the pump outlet 306 allows for a high volume of fluid to flow through the discharge bore 304, and hence through the fluid end assembly 400. This increases the efficiency of the reciprocating pump, and leads to a high output thereof. In a run of the inventive fluid end assembly 400, it was found to operate for approximately 700-1500 hours before pump failure, as compared to conventional fluid end assemblies that were found to operate for approximately 300-400 hours before cavitation and pump failure.

Figure 9A:
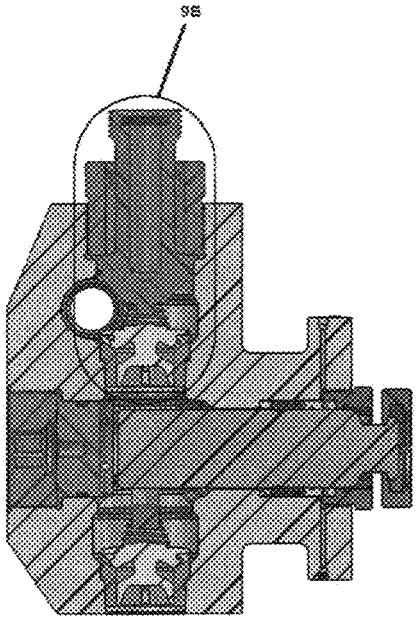
FIGS. 9A-9D illustrate detail views of the inventive fluid end assembly, wherein FIG. 9A corresponds to the sectional side view of FIG. 5B.
Figure 9B:
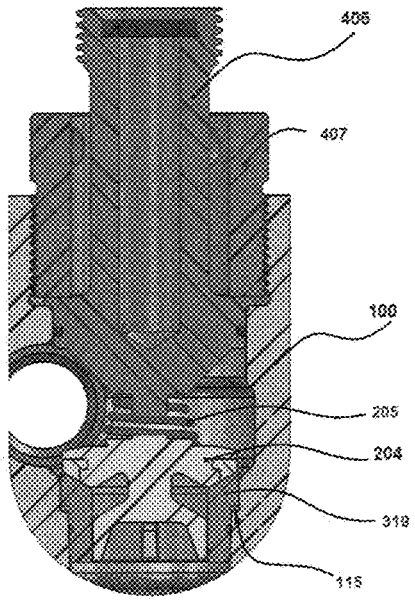
Figure 9C:
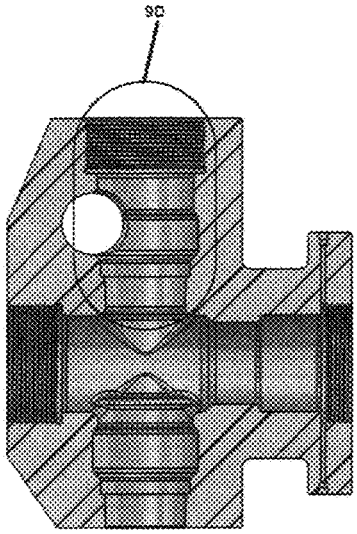
Figure 9D:
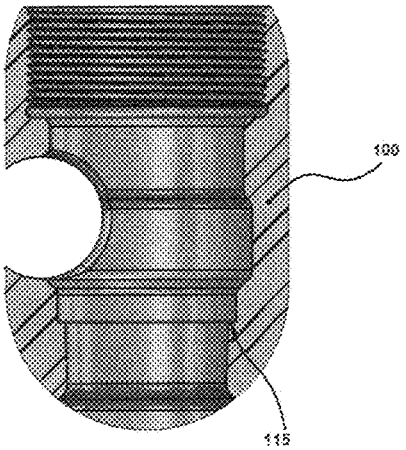

FIG. 9B provides a detail view of the discharge bore of FIG. 9A, wherein the second valve seat deck 115 supports second valve seat 319, upon which sits second spring actuated valve 204 and second spring 205. Cover nut 407 secures discharge cap 406 within the fluid end 100 discharge bore. Valve seat 319 corresponds to the cross-sectional view of second valve seat 318 of FIGS. 4 and 5B.

The recessed seat decks, the modification to the shape of the discharge cover, and the elimination of ninety (90) degree angles within the fluid end assembly yielded the novel present and inventive design. The results of the improved design yielded a reciprocating pump which operated at greater efficiency and longer periods of time before pump failure, in spite of abrasive corrosive fluid media pumped through the assembly.

EXAMPLE

A conventional design and the improved fluid end assembly design were operated under the same conditions and compared for run times and cavitation activity.

8 redesigned fluid end assemblies were tested using Hercules brand pumps. The redesigned bore was 4.5", the discharge cap was conical in shape and the decks were recessed. The fluid end assemblies and pumps operated for at least a 2 hour fracturing stage (also called a pumping time) at approximately 8000 psi. at the wellhole. 400,000 lbs of 100 Mesh fracturing sand was used; It was found that the Hercules improved fluid end assemblies had a life of about 750 hours average (average over the 8 pump assemblies); the Conventional fluid end assemblies had a life of about 300 hours average (average over the 8 pump assemblies). The inventive assembly operated longer without cavitation or pump failure compared to the conventional design.

During the experiments, the inventor was looking for reducing the differential pressure inside the bore. When the pressure is reduced the fluid end assembly does not vibrate as much. It was observed during use that the inventive fluid end assembly did not vibrate as much as a traditional OEM pump system, and the harmonics of the redesigned inventive unit were sharper based on audio testing. This resulted in a more efficient operating pump and fluid end assembly which had a prolonged life.

What is claimed is:

1. A fluid end assembly for a reciprocating pump, comprising:

a body;

a plunger bore formed in the body along a first axis;

a suction bore formed in the body along a second axis, wherein the suction bore receives fluid from a conduit;

a discharge bore formed in the body and aligned perpendicular to the plunger bore;

a horizontal bore formed in the body and aligned with the plunger bore, wherein the plunger bore, the suction bore, the discharge bore, and the horizontal bore intersect to form a cavity;

a reciprocating plunger that reciprocates in the plunger bore;

an inlet valve, received by an inlet valve seat positioned within the suction bore, for facilitating flow of the fluid from the conduit into the cavity by way of the suction bore;

a first valve seat deck at an end portion of the suction bore and in contact with the inlet valve seat;

a pressure relief valve, received by a pressure relief valve seat positioned within the discharge bore, for facilitating flow of the fluid from the cavity into the discharge bore;

a tapered discharge cover received by the discharge bore and in contact with a pressure relief valve spring, wherein a bottom section of the tapered discharge cover is tapered from an upper portion, having a first diameter corresponding to the diameter of the discharge bore at a first horizontal position, to a lower portion, having a second diameter smaller than the first diameter, at a second horizontal position that corresponds to the upper portion of the pressure relief valve spring, such that the lower portion of the bottom section of the tapered discharge cover is in contact with the pressure relief valve spring and the bottom section of the tapered discharge cover extends less than 25% into the radial cross section of a pump outlet that discharges the fluid out of the fluid end assembly;

a second valve seat deck at an end portion of the discharge bore and in contact with the pressure relief valve seat; and an outlet pocket that is defined at an inner surface of the discharge bore and provides a passage for flow of the fluid from the discharge bore to the pump outlet, wherein the pump outlet is cylindrical and is aligned along a third axis, wherein the inlet valve allows the fluid to flow into the cavity based on a reciprocating motion of the reciprocating plunger by way of the suction bore, and wherein the pressure relief valve allows the fluid to flow from the cavity to the discharge bore based on the reciprocating motion of the reciprocating plunger.

2. The fluid end assembly of claim 1, wherein the tapered discharge cover extends less than 20% into the radial cross section of the pump outlet.

3. The fluid end assembly of claim 1, wherein the bottom section of the tapered discharge cover has one of, a convex shape, and a conical shape.

4. The fluid end assembly claim 1, wherein the first valve seat deck is recessed into the suction bore such that a shoulder of an inlet valve seat received by the first valve seat deck is encompassed circumferentially by the suction bore with a clearance distance of no more than 0.03 inches and no less than 0.01 inches.

5. The fluid end assembly of claim 1, wherein the second valve seat deck is recessed into the discharge bore such that a shoulder of a pressure relief valve seat received by the second valve seat deck is encompassed circumferentially by the discharge bore with a clearance distance of no more than 0.03 inches and no less than 0.01 inches.

6. The fluid end assembly of claim 1, wherein a diameter of the pump outlet is greater than 3.25 inches and less than 4.00 inches.

7. The fluid end assembly of claim 1, wherein the discharge bore is substantially devoid of 90 degree angles.

8. The fluid end assembly of claim 7 contoured so as to avoid eddy currents during fluid flow therethrough.

9. The fluid end assembly of claim 1 comprised of a material selected from a group consisting of steel, silicon carbide, vanadium carbide, titanium carbide, molybdenum carbide, and chromium carbide.

10. A fluid end assembly for a reciprocating pump comprising:

a body;

a plunger bore formed in the body along a first axis;

a suction bore formed in the body along a second axis, wherein the suction bore receives fluid from a conduit;

a suction bore formed in the body along a second axis, wherein the suction bore receives fluid from a conduit;

a discharge bore formed in the body and aligned perpendicular to the plunger bore;

a horizontal bore formed in the body and aligned with the plunger bore, wherein the plunger bore, the suction bore, the discharge bore, and the horizontal bore intersect to form a cavity;

a reciprocating plunger that reciprocates in the plunger bore;

an inlet valve, received by an inlet valve seat positioned within the suction bore, for facilitating flow of the fluid from the conduit into the cavity by way of the suction bore;

a first valve seat deck at an end portion of the suction bore and in contact with the inlet valve seat;

a pressure relief valve, received by a pressure relief valve seat positioned within the discharge bore, for facilitating flow of the fluid from the cavity into the discharge bore;

a tapered discharge cover received by the discharge bore and in contact with a pressure relief valve spring, wherein a bottom section of the tapered discharge cover is tapered from a wide upper portion at a horizontal position to a narrow lower portion that corresponds to, and is in contact with, the valve spring and extends less than 25% into the radial cross section of a pump outlet that discharges the fluid out of the fluid end assembly;

a second valve seat deck at an end portion of the discharge bore and in contact with the pressure relief valve seat; and an outlet pocket that is defined at an inner surface of the discharge bore and provides a passage for flow of the fluid from the discharge bore to the pump outlet, wherein the pump outlet is cylindrical and is aligned along a third axis, wherein the inlet valve allows the fluid to flow into the cylindrical and is aligned along a third axis, wherein the inlet valve allows the fluid to flow into the cavity based on a reciprocating motion of the reciprocating plunger by way of the suction bore, and wherein the pressure relief valve allows the fluid to flow from the cavity to the discharge bore based on the reciprocating motion of the reciprocating plunger.

* * * * *